US011470890B2

(12) United States Patent
Sun et al.

(10) Patent No.: US 11,470,890 B2
(45) Date of Patent: Oct. 18, 2022

(54) RAPID INFLATING AND DISCHARGING DEVICE FOR PROTECTIVE SUIT AND INTELLIGENT MULTI-PURPOSE PROTECTIVE SUIT COMPRISING SAME

(71) Applicant: BEIJING MKS RESEARCH INSTITUTE, Beijing (CN)

(72) Inventors: Yingui Sun, Beijing (CN); Hui Elizabeth Zhou, Beijing (CN); Shiguo Wang, Beijing (CN); Sai Zhang, Beijing (CN)

(73) Assignee: BEIJING MKS RESEARCH INSTITUTE, Beijing (CN)

( * ) Notice: Subject to any disclaimer, the term of this patent is extended or adjusted under 35 U.S.C. 154(b) by 343 days.

(21) Appl. No.: 16/753,078

(22) PCT Filed: Oct. 9, 2017

(86) PCT No.: PCT/CN2017/105381

§ 371 (c)(1),
(2) Date: Apr. 2, 2020

(87) PCT Pub. No.: WO2019/071387

PCT Pub. Date: Apr. 18, 2019

(65) Prior Publication Data

US 2020/0237033 A1 Jul. 30, 2020

(51) Int. Cl.
*A41D 7/00* (2006.01)

(52) U.S. Cl.
CPC ..... *A41D 7/003* (2013.01)

(58) Field of Classification Search
CPC .. A41D 13/018; A41D 31/185; A41D 31/184; A41D 13/0025; A41D 13/002; G05B 15/02
See application file for complete search history.

(56) References Cited

U.S. PATENT DOCUMENTS 3,468,299 A * 9/1969 Amato ..... A41D 13/0025 607/104
5,405,370 A * 4/1995 Irani ..... A61F 7/0097 607/104

(Continued)

FOREIGN PATENT DOCUMENTS

CN 2318434 5/1999
CN 1429993 7/2003

(Continued)

OTHER PUBLICATIONS

Search Report issued in Int'l App. No. PCT/CN2017/105381 (dated 2018).

*Primary Examiner* — Richale L Quinn
(74) *Attorney, Agent, or Firm* — Barnes & Thornburg LLP

(57) ABSTRACT

The present invention relates to an rapid inflating/deflating device used for a protective clothing and a smart protective clothing, the inflating/deflating device including: an outer cylinder provided with a first hole; an inner cylinder provided in the outer cylinder and provided with a second hole and being capable of sliding between a first position in which the second hole is aligned with the first hole and a second position in which the second hole is deviated from the first hole and is closed by the inner wall of the outer cylinder; a blade provided in the inner cylinder and a motor driving the blade; a biasing device for biasing the inner cylinder toward the first position; wherein the inner cylinder further comprises a third opening on which an one-way valve is provided so as to allow pressurized gas to flow one-way.

18 Claims, 7 Drawing Sheets

(56) References Cited

U.S. PATENT DOCUMENTS 5,500,952 A * 3/1996 Keyes ..... A41D 13/018 2/908
5,746,442 A * 5/1998 Hoyaukin ..... A41D 13/018 2/456
6,125,478 A * 10/2000 Alaloof ..... A41D 13/018 2/456
6,298,487 B1 * 10/2001 Mayhew ..... A41D 13/018 2/108
7,774,867 B2 * 8/2010 Orita ..... A41D 13/018 2/456
8,595,864 B2 * 12/2013 Orita ..... A41D 13/018 2/102
8,720,751 B2 * 5/2014 Alsaffar ..... A45F 4/10 224/153
8,851,948 B2 * 10/2014 Grutta ..... A62B 33/00 116/210
9,289,633 B2 * 3/2016 Walker ..... B63C 9/18
9,427,625 B2 * 8/2016 Rose ..... A62B 33/00
9,440,133 B2 * 9/2016 Davis ..... A63B 29/021
9,637,210 B2 * 5/2017 Thomson ..... F04D 17/06
9,752,693 B2 * 9/2017 Chaffee ..... A47C 27/083
10,539,941 B2 * 1/2020 Hyde ..... A01K 13/006
10,617,895 B2 * 4/2020 Navez ..... A62B 33/00
11,034,419 B2 * 6/2021 Kuder ..... B63C 9/00
11,058,226 B2 * 7/2021 Hsu ..... A47C 27/087
11,167,912 B2 * 11/2021 Weaver ..... B65D 83/44
2005/0067816 A1 * 3/2005 Buckman ..... A61B 5/6852 280/730.1
2005/0079077 A1 * 4/2005 Tsai ..... F04D 25/084 417/423.15
2006/0213523 A1 * 9/2006 VanDerWoude ... A41D 13/0025 128/863
2006/0222535 A1 * 10/2006 Liu ..... F04D 25/08 417/423.1
2007/0056500 A1 * 3/2007 Beck ..... A63B 29/021 116/210
2008/0076309 A1 * 3/2008 Sandrin ..... A41D 13/0125 441/106
2008/0282453 A1 * 11/2008 Alstin ..... A41D 13/018 2/468
2010/0247337 A1 * 9/2010 Tsai ..... F04D 29/602 417/423.1
2010/0247356 A1 * 9/2010 Tsai ..... F04D 29/602 417/423.14
2012/0060267 A1 * 3/2012 Blenkarn ..... B63C 9/081 2/456
2012/0073035 A1 * 3/2012 Mazzarolo ..... A41D 13/018 2/463
2012/0131718 A1 * 5/2012 Uchida ..... A41D 13/018 2/69
2013/0312168 A1 * 11/2013 Raanan ..... A61B 5/6831 2/465
2015/0173433 A1 * 6/2015 Mazzarolo ..... A41D 13/018 2/463
2015/0308454 A1 * 10/2015 Shi ..... F04D 27/008 415/151
2015/0374060 A1 * 12/2015 Morgan ..... A42B 1/08 2/413
2016/0174626 A1 * 6/2016 Mazzarolo ..... G08B 29/185 2/455
2016/0215780 A1 * 7/2016 Liu ..... F04D 29/053
2017/0181482 A1 * 6/2017 Bruce ..... A41D 27/28
2017/0202279 A1 * 7/2017 Mazzarolo ..... G05B 15/02
2017/0325521 A1 * 11/2017 Li ..... A41D 13/018
2019/0106185 A1 * 4/2019 Kuder ..... A62B 99/00
2019/0166928 A1 * 6/2019 Miwa ..... F04D 29/64
2019/0239578 A1 * 8/2019 Ichigaya ..... A41D 13/005
2020/0309152 A1 * 10/2020 Sanford ..... F04D 29/601
2020/0359714 A1 * 11/2020 Vanneste ..... A41D 13/0025
2020/0359715 A1 * 11/2020 Tokunaga ..... A41D 31/14
2021/0329986 A1 * 10/2021 Mazzarolo ..... A41D 31/145
2021/0360993 A1 * 11/2021 Mazzarolo ..... A41D 13/018
2021/0368872 A1 * 12/2021 Lee ..... F04D 25/084
2022/0001241 A1 * 1/2022 Cholhan ..... A62B 33/00

FOREIGN PATENT DOCUMENTS

| | | |
|---|---|---|
| CN | 2716552 | 8/2005 |
| CN | 102606496 | 7/2012 |
| CN | 102961833 | 3/2013 |
| CN | 105756978 | 7/2016 |
| CN | 205912926 | 2/2017 |
| EP | 0051254 | 5/1982 |
| WO | 2011/148353 | 12/2011 |

* cited by examiner

RAPID INFLATING AND DISCHARGING DEVICE FOR PROTECTIVE SUIT AND INTELLIGENT MULTI-PURPOSE PROTECTIVE SUIT COMPRISING SAME

This application is a United States National Stage Application under 35 USC § 371 of PCT Application No. PCT/CN2017/105381, filed Oct. 9, 2017, the entirety of which is hereby fully incorporated by reference herein.

TECHNICAL FILED

The present invention relates to a rapid inflating/deflating device used for a protective clothing, and to a smart protective clothing comprising such a device which is capable of rapidly adjusting air pressure therein while preserving characteristics of heat insulation, cold resistance, ventilation and heat dissipation of an ordinary clothing.

BACKGROUND

Skiing, driving motorcycles, car-racing, and aerial work, etc. are inherently dangerous due to their speed and altitude. In order to prevent or at least mitigate the damage to a person caused by high-speed collisions or high-altitude drops, a protective clothing that can rapidly adjust the air pressure therein is proposed.

The protective clothing is capable of adjusting the air pressure therein in light with the need in cold resistance and work convenience, and of being smartly and rapidly inflated and pressurized under dangerous conditions, thereby providing damper protection for a person wearing it. However, there are some problems with the current protective clothing. For example, an inflating device used therein is usually composed of an explosive device or a compressed gas device. Therefore, when a danger occurs, a large amount of gas is rapidly released, causing the protective clothing to be filled with gas and to expand, thereby creating a damper barrier. However, the inflating device can usually be used once, i.e. is usually disposable, that is, they cannot be restored after inflating and expansion, rendering the protective clothing not able to be restored to its original state and thus to have to be discarded. This leads to a significant cost for a person who often needs to wear protective clothing.

In addition, a protective clothing provided with an air pump used for inflation was also proposed. However, this kind of protective clothing usually relies on an extraction valve to release the charged gas. Therefore, the deflating process is slow and it is difficult to have the charged air completely extracted. This causes trouble for the storage of protective clothing.

In addition, due to the current protective clothing design in which airbags are disorderly arranged inside the protective clothing, the protective clothing is relatively bloated, so that even when the airbags are not inflated, the person wearing the protective clothing looks bloated and is indeed clumsy.

SUMMARY

It is therefore an object of the present invention to provide an inflating/deflating device used for a protective clothing. With the inflating/deflating device according to the present invention, the protective clothing is able to be rapidly inflated and deflated, and to be repeatedly used. In addition, the air in the protective clothing can be completely discharged, so that the protective clothing can be used for multiple times and convenient for storage and wearing.

In addition, a protective clothing comprising the above-mentioned inflating/deflating device is proposed. In an air-charged state, the protective clothing can ensure the wearer's safety; in an air-discharged and pressure-relieving state, it can be worn like ordinary clothes, without hindering the wearer's movement; and in a vacuum state, it is easy to be stored.

In addition, it is possible to freely fill each air cavity of the protective clothing with fluffy thermal insulation materials such as feathers with the aid of the vacuum discharging function. Besides, the wearer can be prevented from being overly bloated and clumsy and can be stowed at a minimal volume with the adjustment of the air pressure.

According to an aspect of the present invention, an inflating/deflating device is proposed, which comprises: an outer cylinder provided with a first hole; an inner cylinder provided in the outer cylinder and provided with a second hole and being capable of sliding between a first position at which the second hole is aligned with the first hole, and a second position at which the second hole is deviated from the first hole and is closed by an inner wall of the outer cylinder; a blade provided in the inner cylinder and a motor driving the blade; a biasing device for biasing the inner cylinder toward the first position; wherein the inner cylinder further comprises a third opening on which an one-way valve is provided so as to only allow pressurized air to flow from the inner cylinder through the third opening to the outside, while to prevent the pressurized gas from flowing in an opposite direction.

According to another aspect of the present invention, a protective clothing comprising the above-mentioned inflating/deflating device is proposed.

The protective clothing of the present invention can be rapidly inflated for protection purposes and can be rapidly deflated after use to be restored at a flat state for easy storage. Such reusable protective clothing reduces the cost for the user.

According to a second embodiment of the present invention, thanks to the rapid air inflating and deflating capability, high air flow rate and small size of the inflating/deflating devices according to the present invention, the protective clothing may be provided with a plurality of inflating/deflating devices in advance in important parts, and as a result of which, a higher air pressure is obtained in the clothing. In addition, by increasing the number of pressurizing stages of the blade, an even higher air pressure can be obtained.

Preferably, the present invention further comprises a sensor, such as an image sensor or a distance sensor, to sense the distance of the wearer of the protective clothing from an obstacle, so as to realize active protection for the wearer by combining with the above-mentioned air inflating/deflating device. The image sensor or distance sensor is, for example, similar to those used in auto driving and able to make early warning response to a rapidly approaching obstacle, thereby triggering the air inflating/deflating device, and achieving high-level security protection against possible risks, with the rapid high-pressure air inflating capability by virtue of the multi-stage blade.

BRIEF DESCRIPTION OF THE DRAWINGS

The above-mentioned and other features, advantages, and technical superiorities of the present invention can be understood from the following detailed description of preferred embodiments of the present invention with reference to the accompanying drawings, in which.

DETAILED DESCRIPTION OF THE EMBODIMENTS

The following describes in detail an inflating/deflating device according to a preferred embodiment of the present invention and a protective clothing comprising the same. It should be noted that the description is for illustrative purposes only and is not limiting, and those skilled in the art will appreciate that the present invention can be implemented in a variety of ways and should not be limited to the preferred embodiments described herein.

It is also to be noted that in the following description and in the appended claims, "upstream or upstream direction" refers to the direction from which the air originates when the inflating/deflating device is in an air-charging-operation state, and "downstream or downstream direction" refers to the direction in which the air flows when the inflating/deflating device is in the air-charging-operation state.

Figure 1:
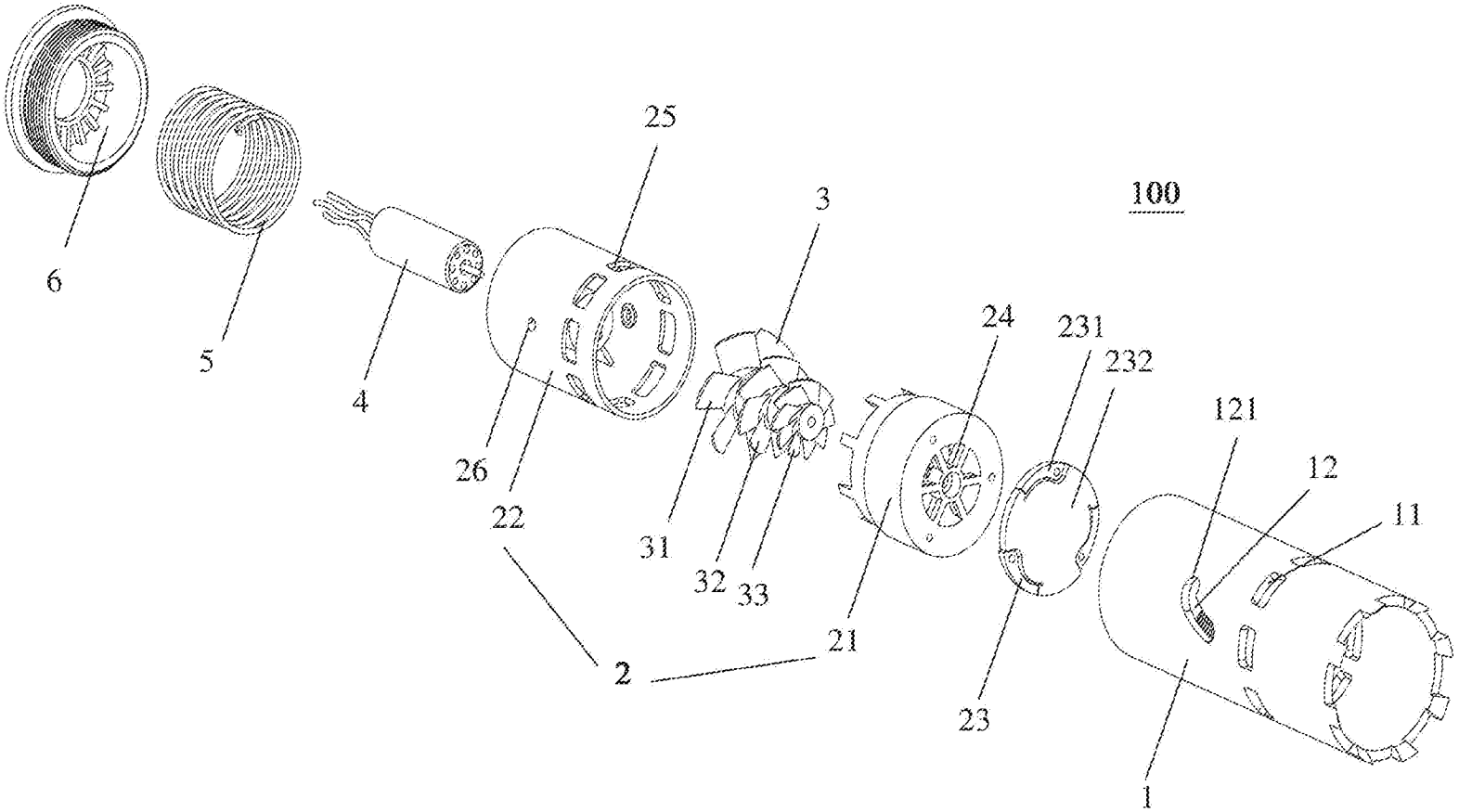
FIG. 1 is an exploded perspective view showing an inflating/deflating device according to a preferred embodiment of the present invention.
Figure 2:
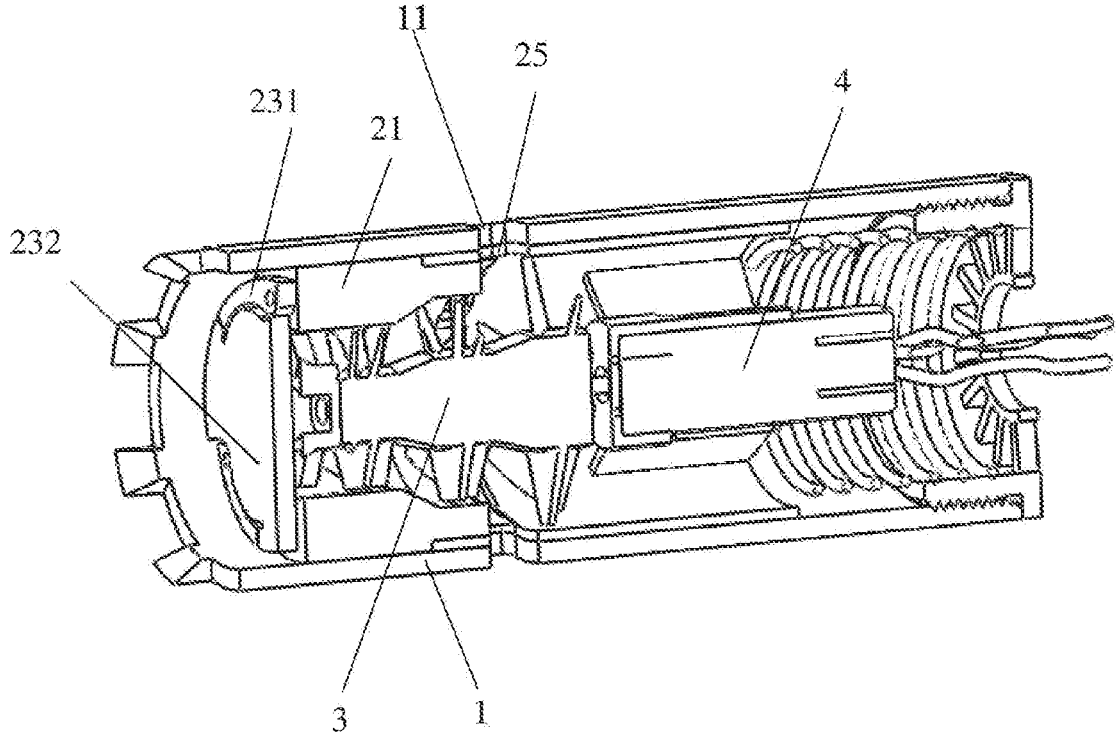
FIG. 2 is a view showing the inflating/deflating device shown in FIG. 1 in an initial air charging state.

Referring first to FIG. 1, FIG. 1 is an exploded perspective view showing an inflating/deflating device according to a preferred embodiment of the present invention. As shown in FIG. 1, the air inflating/deflating device 100 comprises an outer cylinder 1 and an inner cylinder 2 slidably installed in the outer cylinder 1. The inner cylinder 2 is divided into two portions, i.e., a blade accommodation portion 21 and a motor accommodation portion 22. A valve 23 is provided on the downstream end of the blade accommodation portion 21 of the inner cylinder. In the blade accommodating portion 21 of the inner cylinder, a blade 3, which is preferably multi-stage blade, is provided so as to pressurize the intake air to a higher pressure, and in the motor accommodation portion 22, a motor 4, which is preferably a reversible motor that is capable of rotating in both directions, is provided. An end cap 6 is further provided on the upstream end of the outer cylinder 1, for example, by being screwed to the outer cylinder 1, and holes are provided on the end cap 6 to allow the electric wires of the motor 4 to pass through and to allow air to be taken in while to block larger foreign substance. A biasing spring 5 is provided between the inner cylinder 2, specifically, the upstream end of the motor accommodating portion 22 of the inner cylinder 2, and the end cover 6, and biases the inner cylinder 2 in a downstream direction.

The outer cylinder 1 is open at its downstream end, and the inner cylinder 2 may be provided with a plurality of holes 24 in the end surface of its upstream end to allow air to pass through. The outer cylinder 1 is provided with a plurality of holes 11 which are for example square holes on its peripheral wall. The inner cylinder 1 is also provided with a plurality of holes 25 on its peripheral wall that are corresponding to and of for example the same shape as the holes 11 on the outer cylinder. The holes 11 and 25 are provided at the same interval, and preferably, both provided at equal intervals around the circumferential direction.

As shown in FIG. 1, at the downstream end of the inner cylinder 2 a valve 23 is provided, the valve 23, for example, is of diaphragm type. The valve 23 comprises a valve body 232 and a leg 231 which is extending from a circumferential position of the valve body 232 and with which the valve 23 is fixed to the end surface of the downstream end of the inner tube 2. Preferably, a plurality of legs are provided in the circumferential direction (three are shown in the figure).

As shown in FIG. 1, a guide slot 12 is provided at a substantially intermediate position of the outer cylinder 1. Preferably, more than one guide slot 12 is provided, for example, two, three or more guide slots 12 that are evenly spaced apart in the circumferential direction are provided. A corresponding pin hole 26 is provided at a corresponding position of the inner cylinder 2 to receive a guide pin (not shown).

During assembly, the inner cylinder 2 is inserted into the outer cylinder 1, and the guide pin is inserted into the pin hole 26 through the guide slot 12 and fixed to the inner cylinder 2. The inner cylinder 2 can thereby slide inside the outer cylinder 1 under the guidance of the guide slot 12.

As shown in FIG. 1, the guide slot 12 is preferably arranged to be inclined with respect to a longitudinal axis of the outer cylinder 1 and may have a certain curvature. Therefore, during the sliding process of the inner cylinder 2 along the guide slot 12, the inner cylinder 2 carries out not only translational movements along the longitudinal axis of the outer cylinder 1 but also rotational movements about the longitudinal axis.

Each end of the guide slot 12 respectively constitutes a stop position of the inner cylinder 2. Specifically, when the guide pin is at the downstream end of the guide slot 12, the inner cylinder 2 is in a downstream position, and the hole 25 in the circumferential direction thereof and the hole 11 in the circumferential direction of the outer cylinder 1 are aligned with each other, while when the guide pin is at the upstream end of the guide slot 12, the inner cylinder 2 is in an upstream position, and the hole 25 of the inner cylinder 2 are not aligned with the hole 11 of the outer cylinder 1 and closed by the cylinder wall of the latter.

A spring 5 is provided between the upstream end of the inner cylinder 2 and the end cap 6 at the upstream end of the outer cylinder 1 to bias the inner cylinder 2 toward the downstream direction, that is, toward the downstream position.

As shown in FIGS. 1 to 5, the blade 3 adopts a three-stage blade, and comprises a first diameter blade 31, a second diameter blade 32, and a third diameter blade 33 in a direction from upstream to downstream, the first diameter blade 31 has a diameter being larger than that of the second diameter blade 32, and the diameter of the second diameter blade 32 is larger than that of the third diameter blade 33, making the air to be pressurized stage by stage. In addition, the above-mentioned three-stage blade is merely exemplary, and more or fewer stages in the blade may be provided according to different needs to generate the required higher air pressure.

As shown in FIGS. 2 to 5, the blade accommodating portion 21 of the inner cylinder 2 comprises an inner cavity with varying diameters in which the second diameter blade 32 and the the third diameter blade 33 of the blade 3 are accommodated. The dimensions of the inner cavity substantially correspond to those of the second diameter blade and the third diameter blade such that the inner cavity envelopes these two stages of the blade. This facilitates pressurizing the air to higher pressures.

In the motor accommodating portion 22 of the inner cylinder 2, there is provided a motor 4 for driving the blade 3, the motor is a reversible motor and wires of the motor are led out from the end cap 6 to be connected to a control circuit (not shown). The holes 25 are formed on the peripheral wall of the motor accommodating portion 22 and at a longitudinal position substantially corresponding to the first diameter blade 31.

Hereinafter, referring to FIGS. 2 to 5, the operation modes of the inflating/deflating device according a preferred embodiment of the present invention will be briefly described. The following description is provided in the case that the inflating/deflating device is arranged in a protective clothing, but it should be appreciated that it can also be used in various target objects that require air charging and discharging, and the present invention is not limited hereto.

Figure 3:
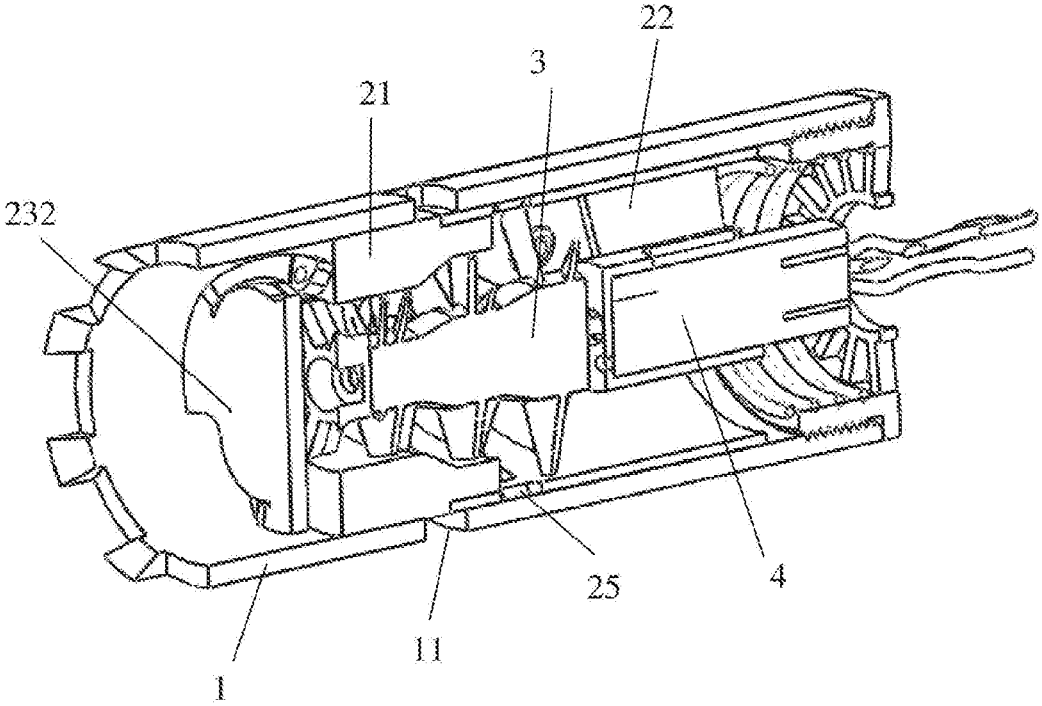
FIG. 3 is a view showing the inflating/deflating device shown in FIG. 1 in a pressurized state.
Figure 4:
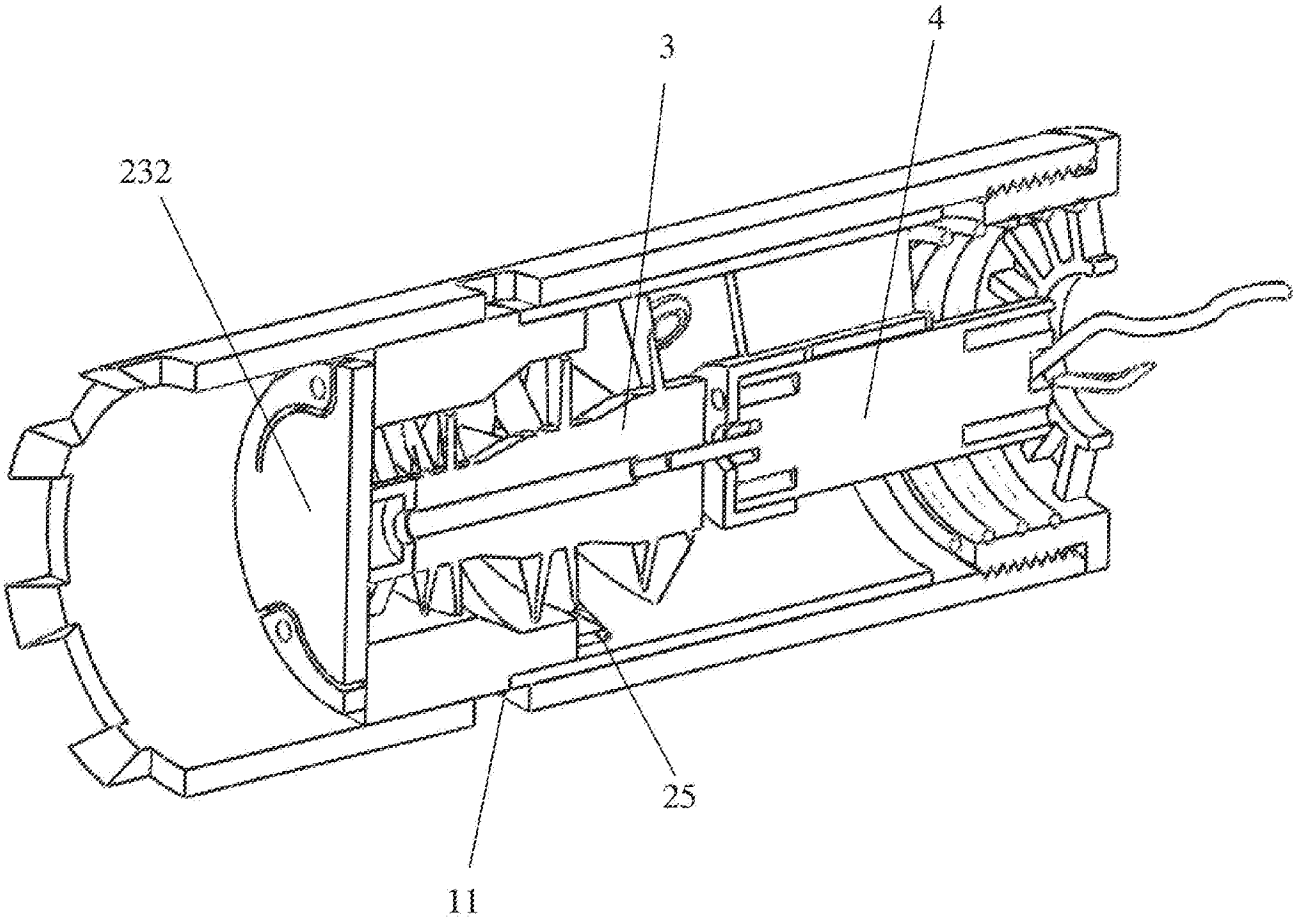
FIG. 4 is a view showing the inflating/deflating device shown in FIG. 1 in a state of completion of air charging.
Figure 5:
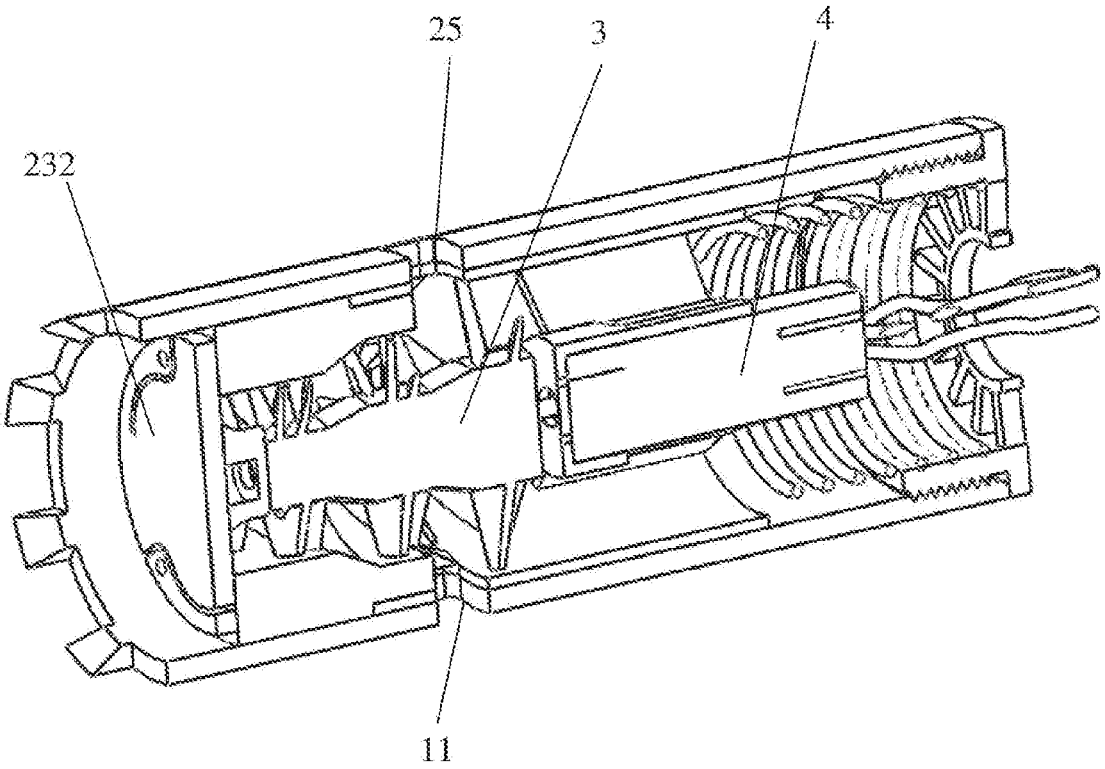
FIG. 5 is a view showing the inflating/deflating device shown in FIG. 1 in an air discharging state.

As shown in FIGS. 2 to 5, under the effect of the spring 4, the inner cylinder 2 is biased to the downstream position, and the holes 25 of the inner cylinder 2 are aligned with the holes 11 of the outer cylinder 1, then the motor 4 is energized, and thus air is taken in from the end cap 6 and pressurized by the third-stage blade 3, so as to be charged into a target object. Specifically, a part of the air pressurized by the first diameter blade 31 is injected into the target object, such as an inner cavity of a protective clothing, through the aligned holes 25 and 11, and another part of the pressurized air is continued to be pressurized through the second diameter blade 32 and the third diameter blade 33 to force the valve 23 open, and so as to be charged into the protective clothing from the downstream end of the inner cylinder 2. The acting force of the air in the protective clothing increases as the pressure thereof increases, thereby pushing the valve body 232 of the valve 23 toward the end surface of the downstream end of the inner cylinder 2 and simultaneously moving the inner tube 2 in the upstream direction against the bias force of the spring 5. As a result, the inner cylinder 2 moves and rotates under the guidance of the guide slot 12 until the guide pin abuts against the upstream end of the guide slot 12, and then the hole 25 of the inner cylinder 2 is closed by the cylinder wall of the outer cylinder 1, causing the air is stopped to be supplied into the target object through the holes 25 and 11. At this time, the air is further pressurized by the second diameter blade 32 and the third diameter blade 33, and when the air has a pressure greater than that in the protective clothing, it forces the valve 23 open and then continues to be charged into the protective clothing through the downstream end of the inner cylinder 2, as shown in FIG. 3.

As the pressure of the air in the protective clothing increases, the air pressure in the protective clothing and the pressure of the air pressurized by the blade 3 balance, and at this time, the valve body 232 of the valve 23 is pressed against the end surface of the downstream end of the inner cylinder 2, then a pressure-holding state is reached. Preferably, a sensor 254, such as a pressure sensor, is provided to turn off the power supply to the motor 4 when this state is reached.

Preferably, at the upstream end of the guide slot 12, a stop section 121 extending in the circumferential direction is provided. When the inner cylinder 2 is pushed in the upstream position along the upstream direction due to the air pressure in the protective clothing, the guide pin falls into the stop section 121 as a result of a rotation inertia of the inner cylinder 2 along the inclined guide slot 12.

In the case in which air discharging is desired, the motor and the thus the blade 3 rotate in a direction opposite to that for air charging. Under the instantaneous torque of the blade 3 starting to rotate, the inner cylinder 2 also rotates with the blade 3, thereby causing the guide pin escape out of the stop section 121, and under the suction effect of the blades 3 and the elastic effect of the spring 5, the inner cylinder 2 moves toward the downstream direction, at the same time, the guide pin sliding along the guide slot 12, rendering the holes 11 and 25 to gradually overlap, and then an air discharging position in which the holes 11 and 25 are completely aligned shown in FIG. 5 being reached, thereby all of the air in the protective clothing can be rapidly discharged.

Preferably, another sensor is further provided to automatically stop the operation of the motor 4 after the air is discharged. Alternatively, motor 4 can be turned off by manual operation.

Due to the use of the three-stage blade 3, the air can be pressurized to a higher pressure and rapidly released and discharged as desired.

It can be seen from the above description that, in the present invention, by adopting a simple structure, rapid air charging and discharging operations are possible, and the air charging and discharging operations can be performed automatically, requiring little manual intervention.

Figure 6B:
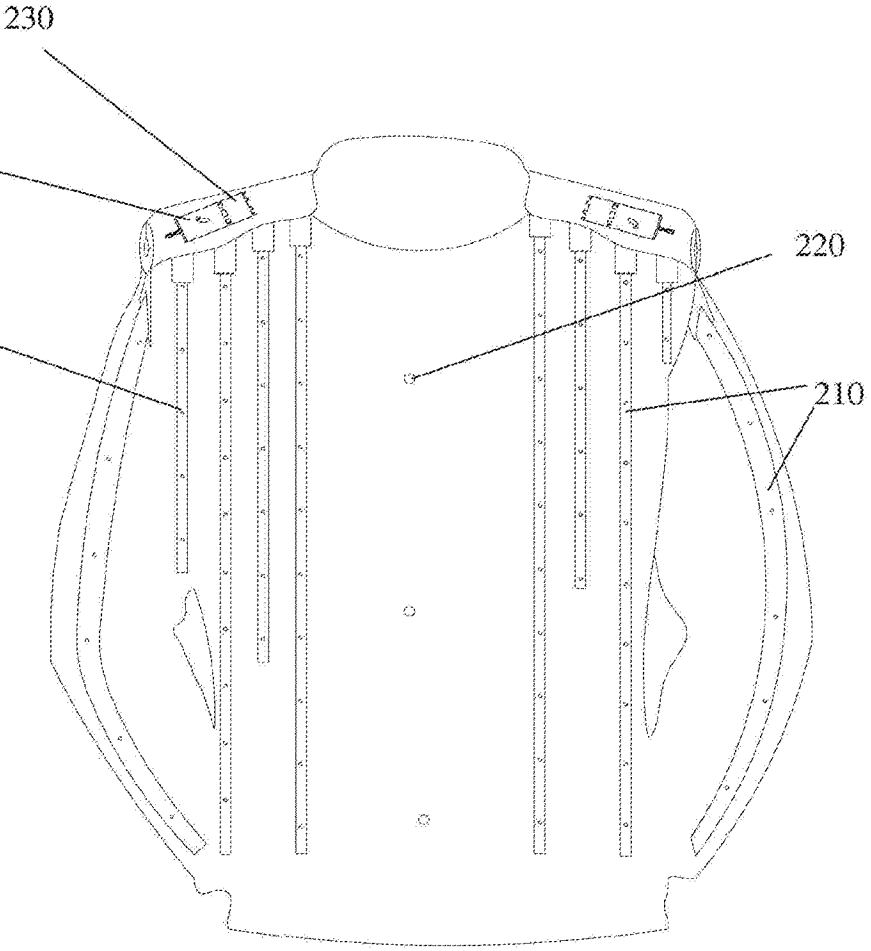
FIGS. 6A and 6B are schematic views showing a protective clothing equipped with the inflating/deflating device shown in FIG. 1.

Hereinafter, a protective clothing 200 employing the inflating/deflating device in the above embodiment is described with reference to FIGS. 6A and 6B.

Figure 6A:
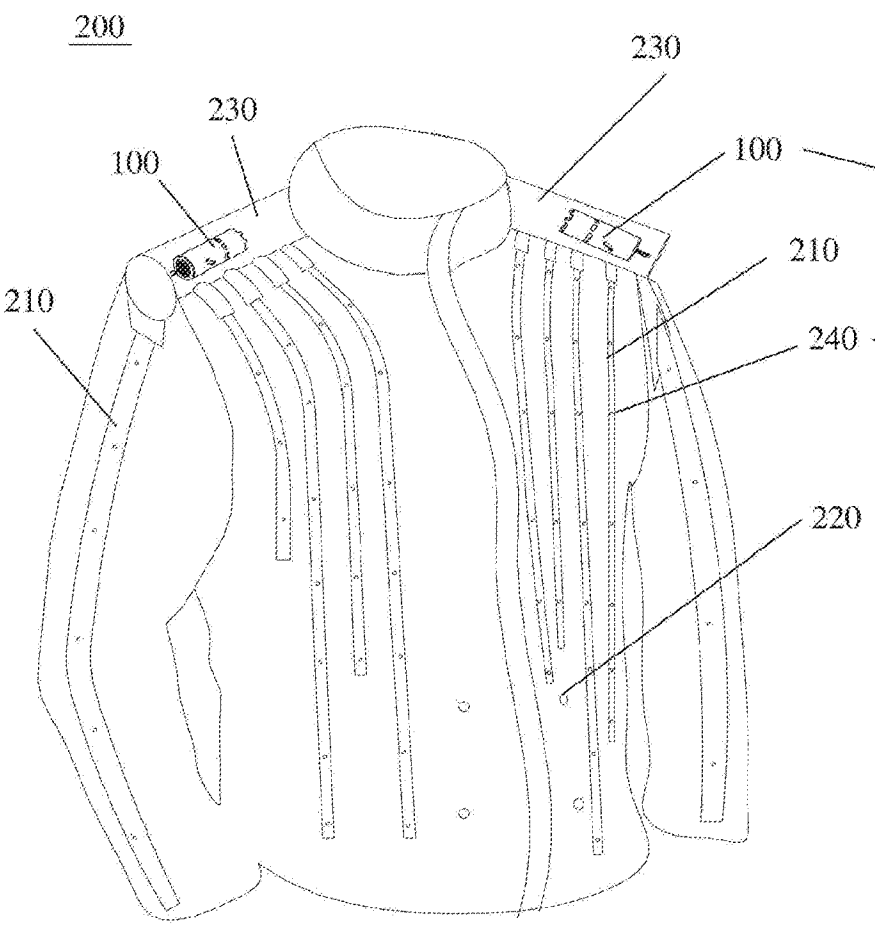
Figure 7:
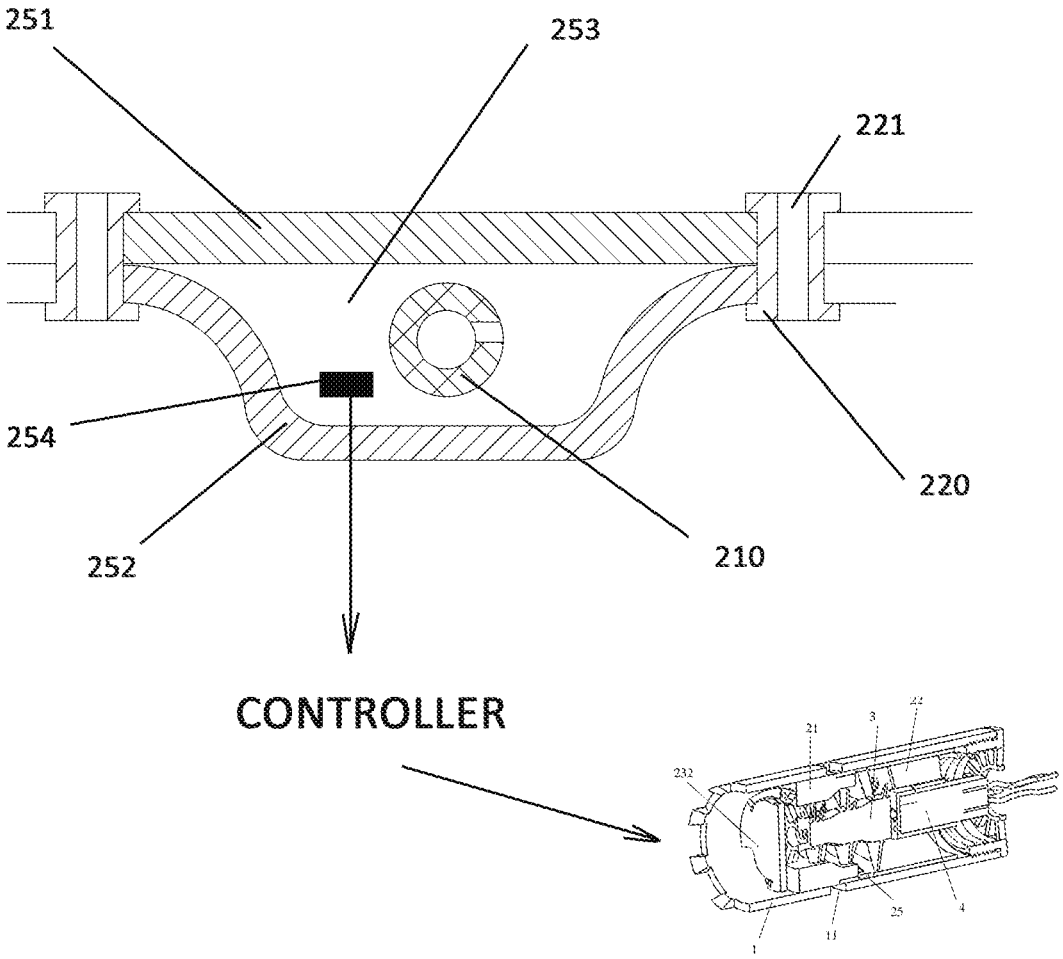
FIG. 7 is a sectional view showing a part of the clothing in FIG. 6A and FIG. 6B.

As shown in FIG. 6A and FIG. 7, the protective clothing 200 is made of a gas-impermeable material and constituted of an outer layer 251 and an inner layer 252 with a closed cavity 253 formed therebetween, air is able to be charged into this cavity 253 to bring the protective clothing into an inflated state. An air chamber 230 in which the inflating/deflating device 100 can be arranged is, for example, formed on the shoulder of the protective clothing 200 and is sealed from the cavity. Although the figure shows that two air chambers 230 each accommodating one inflating/deflating device 100 are formed on the left and right shoulders of the protective clothing, the present invention is not limited thereto, and only one air chamber 230 and one inflating/deflating device 100 may be provided, or multiple air chambers and air charging and discharging devices may be provided.

The air chamber 230 is connected to a plurality of air pipes 210 which extend into the cavity of the protective clothing, and in the wall of the air pipes, a plurality of air holes 240 are formed. When the inflating/deflating device 100 performs air charging, air from outside can be taken in the air chamber 230 and is pressured by the inflating/deflating device. The pressurized air can be forced to flow through the air pipes 210 and into the cavity of the protective clothing, thereby the cavity being inflated; and in particular, in the case of air discharging operation, the air is likewise smoothly evacuated from the cavity of the protective clothing through the air holes 240 of the air pipes 210.

Ventilation structures are provided at several positions of the protective clothing, for example, hollow rivets 220 are arranged by penetrating the outer and inner layers of the protective clothing to form a ventilation hole 221 passing through the outer layer and the inner layer, thereby ventilation of the protective clothing is possible without air leak therefrom, avoiding discomfort for those wearing the protective clothing.

The cavity of the protective clothing may be additionally filled with a warm material such as duck down. In this case, the provision of the hollow rivet 220 is beneficial to prevent the warm material from being displaced in the cavity. In addition, a controller (FIG. 7) and/or a switch for controlling the inflating/deflating device 100 may be provided at a position such as a cuff or the like for easy manual manipulation.

Although the protective clothing is shown above as an upper outer garment, a pants-type protective clothing is also possible. In the latter case, the inflating/deflating device 100 may be provided at a position such as a trouser leg.

The protective clothing according to the present invention may be provided with a sensing mechanism 254, which may include, for example, an acceleration sensor, a proximity sensor, a gyroscope, an image sensor, etc., in order to sense the wearer's speed, acceleration, and distance from the wearer to a closest obstacle, or to sense an outside object or person that is rapidly approaching the wearer of the protective clothing, and to trigger the inflating/deflating device to rapidly inflate the protective clothing and protect the wearer's personal safety when one or more of the speed, acceleration, and distance reaches a predetermined threshold that may be set based on the probability of a collision between the wearer and the obstacle. After the dangerous situation has passed, the protective clothing can be manually deflated, so that the protective clothing is worn like ordinary clothing to avoid hindering the wearer's movement.

In addition, before engaging in hazardous work, the wearer of the protective clothing may actively inflate or partially inflate the protective clothing in order to protect against danger in advance.

After taking off the protective clothing, since the protective clothing can be easily inflated and deflated, it can be folded and stored like ordinary clothing, which improves the convenience of storage. In addition, the protective clothing according to the present invention can be used repeatedly for many times, reducing the cost for use.

Although the present disclosure has been described with reference to exemplary embodiments, it will be understood by those skilled in the art that various changes and modifications may be made without departing from the spirit and scope of the present disclosure. Therefore, it should be understood that the above-mentioned embodiments are not restrictive, but illustrative.

What is claimed is:

1. An inflating/deflating device used for a protective clothing, comprising:

an outer cylinder on which at least one first hole is provided;

an inner cylinder arranged within the outer cylinder, provided with at least one second hole, and being capable of sliding between a first position at which the second hole is aligned with the first hole, and a second position at which the second hole is deviated from the first hole and is closed by the inner wall of the outer cylinder;

a blade provided in the inner cylinder and a motor driving the blade;

a biasing device for biasing the inner cylinder toward the first position;

wherein the inner cylinder further comprises a third opening on which a one-way valve is provided so as to only allow pressurized gas to flow from the inner cylinder through the third opening to the outside, while to prevent the pressurized gas from flowing in an opposite direction, wherein the outer cylinder is provided with a guide slot and the inner cylinder is provided with a guide pin that cooperates with the guide slot to guide the sliding of the inner cylinder within the outer cylinder between the first position and the second position, and wherein the guide slot is inclined with respect to a longitudinal direction of the outer cylinder so as to guide the inner cylinder to move and rotate.

2. The inflating/deflating device as claimed in claim 1, wherein the at least one first hole is provided on a peripheral wall of the outer cylinder, and the at least one second hole is provided on a peripheral wall of the inner cylinder.

3. The inflating/deflating device as claimed in claim 1, wherein the guide slot is provided with a stop section at a portion corresponding to the second position of the inner cylinder.

4. The inflating/deflating device as claimed in claim 1, wherein the blade is a three-stage blade comprising a first diameter blade, a second diameter blade and a third diameter blade, wherein the first diameter blade has a diameter larger than a diameter of the second diameter blade, and the diameter of the second diameter blade is larger than that of the third diameter blade.

5. The inflating/deflating device as claimed in claim 4, wherein the inner cylinder comprises a blade accommodation portion for receiving the second diameter blade and the third diameter blade and a motor accommodation portion for receiving the first diameter blade and the motor, and the second hole is formed on a peripheral wall of the motor accommodation portion at the position corresponding to the first diameter blade.

6. The inflating/deflating device as claimed in claim 5, wherein the blade accommodating portion comprises an inner cavity that receives the blade and the shape of which conform to envelope of the second diameter blade and the third diameter blade.

7. A protective clothing, comprising, a protective clothing comprising a cavity and an inflating/deflating device, the inflating/deflating device being in communication with the cavity to so as to charge the cavity with air or discharge the air from the cavity, the inflating/deflating device comprises:

an outer cylinder on which at least one first hole is provided;

an inner cylinder arranged within the outer cylinder, provided with at least one second hole, and being capable of sliding between a first position at which the second hole is aligned with the first hole, and a second position at which the second hole is deviated from the first hole and is closed by the inner wall of the outer cylinder;

a blade provided in the inner cylinder and a motor driving the blade;

a biasing device for biasing the inner cylinder toward the first position;

wherein the inner cylinder further comprises a third opening on which a one-way valve is provided so as to only allow pressurized gas to flow from the inner cylinder through the third opening to the outside, while to prevent the pressurized gas from flowing in an opposite direction;

wherein the outer cylinder is provided with a guide slot and the inner cylinder is provided with a guide pin that cooperates with the guide slot to guide the sliding of the inner cylinder within the outer cylinder between the first position and the second position, and wherein the guide slot is inclined with respect to a longitudinal direction of the outer cylinder so as to guide the inner cylinder to move and rotate.

8. The protective clothing claimed in claim 7, wherein the protective clothing comprises an outer layer and an inner layer, the cavity being formed therebetween, and wherein the inner layer and the outer layer are formed of an air-impermeable material or the inner layer and the outer layer respectively includes an air-impermeable material layer.

9. The protective clothing claimed in claim 8, wherein the protective clothing further comprises an air chamber which is sealed from the cavity and in which at least one of the inflating/deflating device is disposed.

10. The protective clothing claimed in claim 9, wherein the protective clothing further comprises a plurality of air pipes which are in communication with the air chamber and extended and distributed in the cavity, on wall of the plurality of air pipes a plurality of air holes are provided to charge air from the air chamber to the cavity.

11. The protective clothing claimed in claim 10, wherein the protective clothing further comprises ventilation holes passing through the outer layer and the inner layer and sealed from the cavity.

12. The protective clothing claimed in claim 7, wherein the protective clothing further comprises a sensor to sense at least one of speed, acceleration, distance from a wearer of the protective clothing to an obstacle, and distance from the wearer to an outside object or another person that is approaching the wearer of the protective clothing.

13. The protective clothing claimed in claim 12, wherein the protective clothing further comprises a controller that receives a signal from the sensor and triggers the inflating/deflating device to inflate the cavity when the signal from the sensor reaches a predetermined threshold.

14. The protective clothing claimed in claim 7, wherein a pressure sensor is further comprised to sense the pressure in the cavity of the protective clothing, and when the pressure reaches a predetermined pressure, the power supply of the inflating/deflating device is disconnected.

15. The protective clothing claimed in claim 7, wherein the outer cylinder is provided with a guide slot and the inner cylinder is provided with a guide pin that cooperates with the guide slot to guide the sliding of the inner cylinder within the outer cylinder between the first position and the second position.

16. The protective clothing claimed in claim 15, wherein the guide slot is inclined with respect to a longitudinal direction of the outer cylinder so as to guide the inner cylinder to move and rotate.

17. The protective clothing claimed in claim 7, wherein the at least one first hole is provided on a peripheral wall of the outer cylinder, and the at least one second hole is provided on a peripheral wall of the inner cylinder.

18. The protective clothing claimed in claim 17, wherein the guide slot is provided with a stop section at a portion corresponding to the second position of the inner cylinder.

* * * * *